United States Patent [19]

Patel

[11] 4,052,953

[45] Oct. 11, 1977

[54] FLUSHING DEVICE FOR OUTBOARD MOTORS

[75] Inventor: Raman A. Patel, Oak Park, Ill.

[73] Assignee: Outboard Marine Corporation, Waukegan, Ill.

[21] Appl. No.: 678,027

[22] Filed: Apr. 19, 1976

[51] Int. Cl.[2] ..... B08B 3/02; B08B 9/00

[52] U.S. Cl. ..... 134/167 R; 115/75; 134/169 A; 134/199; 285/197

[58] Field of Search ..... 115/.5 HC, 17, 75, 76; 134/166 R, 167 R, 169 A, 199; 285/197, 189; 24/68 R, 71 T, 71 ST, 270, 204

[56] References Cited

U.S. PATENT DOCUMENTS

| | | | |
|---|---|---|---|
| 696,574 | 4/1902 | Laros | 24/71 ST |
| 2,611,631 | 9/1952 | Benson | 285/197 |
| 3,003,456 | 10/1961 | Crozier | 115/17 |
| 3,931,828 | 1/1976 | Lawler | 134/167 R |

*Primary Examiner*—Trygve M. Blix
*Assistant Examiner*—Gregory W. O'Connor
*Attorney, Agent, or Firm*—Michael, Best & Friedrich

[57] ABSTRACT

Disclosed herein is a flushing device for supplying fluid to a water intake port on a lower unit of an outboard motor. The device comprises a flexible strap having a first end and a second end, along with a buckle connected to the first end. The buckle includes a kinked portion which has a cross member and which is adapted for engagement with the lower unit, which buckle also includes an over-the-center latch pivotally connected to the kinked portion. The buckle also includes a strap link connected to the first end of the strap and connected to the latch at a point radially outwardly spaced from the kinked portion pivotal connection with the latch. A cup-shaped member is connected to the strap and spaced from the buckle, which member is adapted for sealing engagement with the lower unit and for covering the water intake port. The cup-shaped member includes a conduit adapted for communication with the water intake port and with a source of fluid. Reciprocal fastening devices are connected to the strap and spaced adjacent the second end so that when the strap is looped around the cross member, the reciprocal fastening devices can be aligned and connected together, and so that when the latch is pivoted over center about the kinked portion pivotal connection, the strap is tightened and locked around the lower unit.

16 Claims, 5 Drawing Figures

FLUSHING DEVICE FOR OUTBOARD MOTORS

BACKGROUND OF THE INVENTION

The invention relates to flushing devices for marine propulsion devices such as an outboard motor. Generally, a flushing device provides a means to introduce fresh cold water to the water intake port of an outboard motor, thereby enabling the motor to be cleaned or flushed with clean water without the necessity of removing the motor from the boat. Prior flushing devices for outboard motors are disclosed in Benson U.S. Pat. No. 2,611,631 issued Sept. 23, 1952 and in Guhlin U.S. Pat. No. 3,002,488 issued Oct. 3, 1961.

SUMMARY OF THE INVENTION

The invention disclosed herein provides a flushing device which can be conveniently secured to different size outboard motors.

In accordance with an embodiment of the invention, there is provided a flushing device for supplying fluid to a water intake port on a lower unit of an outboard motor. The device comprises a flexible strap having a first end and a second end, together with a buckle connected to the first end, which buckle includes a kinked portion adapted for engagement with the lower unit. A member is connected to the strap and spaced from the buckle, which member is adapted for sealing engagement with the lower unit and for covering the water intake port. The member includes a conduit adapted for communication with the water intake port and with a source of fluid. Spaced reciprocal fastening means are connected to the strap adjacent the second end for securing the strap around the lower unit.

Also in accordance with an embodiment of the invention, there is provided a flushing device for an outboard motor having a lower unit with sidewalls which join together to form an apex. The kinked portion of the buckle of the flushing device is adapted to fit over and engage the apex thereby registering the member with respect to the water intake port.

Also in accordance with an embodiment of the invention, there is provided a flushing device wherein the buckle includes an over-the-center latch pivotally connected to the kinked portion, which kinked portion includes a cross member. The buckle also includes means for connecting the first end of the flexible strap to the latch at a point radially outwardly spaced from the kinked portion pivotal connection with the latch. The strap loops around the cross member so that the reciprocal fastening means can be aligned and connected together, which strap is then tightened and locked around the lower unit when the latch is pivoted over center about the kinked portion pivotal connection.

Also in accordance with an embodiment of the invention, there is provided a flushing device wherein the connecting means comprises a strap link connected to the first end of the strap, which strap link has an end portion spaced from the first end of the strap and pivotally conected to the latch.

Also in accordance with an embodiment of the invention, there is provided a flushing device wherein the strap includes an aperture spaced from the buckle, and wherein the member comprises a cup-shaped member and the conduit extends through the aperture, which conduit has a rotatably mounted adapter for connection to a garden hose.

Also in accordance with an embodiment of the invention, there is provided a flushing device wherein the member is dimensioned to sealingly engage different size lower units, and wherein the reciprocal fastening means comprise a first fastening member adjacent the second end and a plurality of reciprocal second fastening members spaced from the first fastening member for adjustably securing the strap around the different size lower units.

Also in accordance with an embodiment of the invention, there is provided a flushing device wherein the strap is composed of nylon, and wherein the reciprocal fastening means include a male snap and a female snap.

Also in accordance with an embodiment of the invention, there is provided a flushing device wherein the reciprocal fastening means include a male Velcro tape portion and a female Velcro tape portion, which Velcro tape portions provide a range of continuous adjustment for securing the strap around the size lower units.

One of the principal features of the invention is the provision of a flushing device comprising a flexible strap connected to a buckle having a kinked portion adapted for engagement with the lower unit of an outboard motor, and also comprising spaced reciprocal fastening means connected to the strap, which flushing device can be simply and conveniently secured around the lower unit of an outboard motor.

Another of the principal features of the invention is the provision of a flushing device including a cup-shaped member connected to the flexible strap and dimensioned to sealingly engage different size lower units, which flushing device also includes a plurality of spaced reciprocal fastening means connected to the strap for adjustably securing the flushing device around the different size lower units.

Another of the principal features of the invention is the provision of a flushing device having a buckle which includes an over-the-center latch pivotally connected to the buckle kinked portion engaging the lower unit, which latch, when pivoted over center, tightens the strap and locks the flushing device around the lower unit in a simple and reliable manner without the use of tools.

Other features and advantages of the embodiments of the invention will become known by reference to the following drawings, general description and claims.

DRAWINGS

Figure 1:
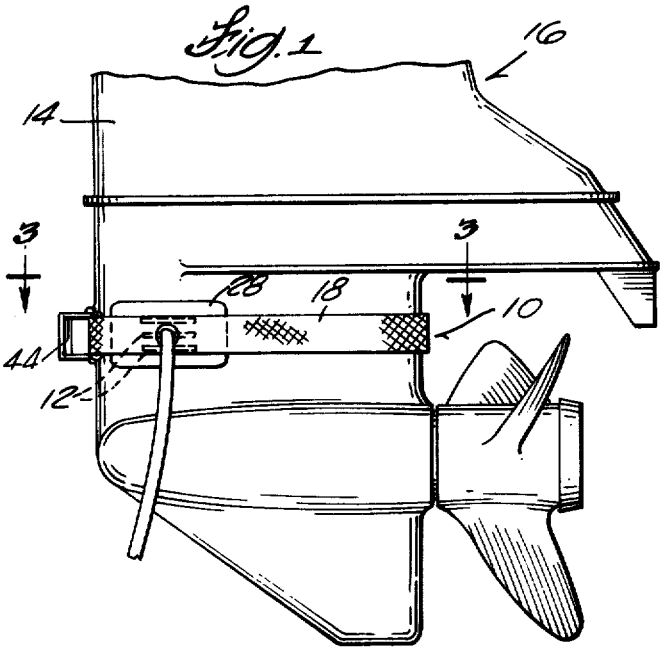
FIG. 1 is a side plan view of a flushing device installed on the lower unit of an outboard motor, which flushing device embodies various of the features of the invention.

Before explaining the embodiments of the invention in detail, it is to be understood that the invention is not limited in its application to the details of construction and the arrangement of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

GENERAL DESCRIPTION

Shown in the drawings is a flushing device 10 for supplying fluid to a water intake port 12 on a lower unit 14 of an outboard motor or other marine propulsion device such as a stern drive unit. The flushing device comprises a flexible strap 18 having a first end 20 and a second end 22. The flexible strap 18 can be composed of any durable flexible material, and in the preferred embodiments shown, is composed of nylon.

The flushing device 10 includes a buckle 24 connected to the first end 20 of the strap 18, which buckle includes a kinked portion 26 adapted for engagement with the lower unit 14. The flushing device also includes a member 28 connected to the strap 18 and spaced from the buckle 24. The member 28 is adapted for sealing engagement with the lower unit 14 and for covering the water intake port 12. The member includes a conduit 30 adapted for communication with the water intake port 12 and with a source of fluid.

While various configurations are possible, the member 28 is preferably rectangular and cup-shaped and is composed of an elastomeric material such as rubber which provides a good seal with the surface of the lower unit 14. The cup-shaped member 28 is dimensioned to sealingly engage different size lower units, and hence a single flushing device can be used on different size outboard motors.

The member 28 preferably is connected to strap 18 by the conduit 30 which extends through an aperture 31 in the top of the cup-shaped member 28 and through an aperture 32 in the strap 18, which aperture 32 is spaced from the buckle 24. More specifically, the aperture 32 is spaced a predetermined distance from the kinked portion 26 of the buckle 24 to thereby register the member 28 with respect to the water intake port 12.

While various arrangements are possible, the conduit 30 preferably comprises a cylindrical metallic fitting extending through the apertures 31 and 32 and having deformable outer portions 33 which are crimped together so as to secure the member 28 and strap 18 between them. The conduit 30 preferably includes a rotatably mounted female adapter 35 suitable for sealing engagement with the male fitting of a conventional garden hose as illustrated in the FIG. 3.

The flusing device also includes fastening means on the strap 18 for securing the strap 18 around the lower unit. In the specifically disclosed construction, such fastening means includes spaced reciprocal fastening means located adjacent the second end 22 of the strap 18. Various types of reciprocal fastening means or fastening members can be used. As shown in the embodiment of the invention illustrated in FIGS. 2 and 3, the reciprocal fastening means comprise fastening members which include a female snap 34 and a male snap 36.

Figure 4:
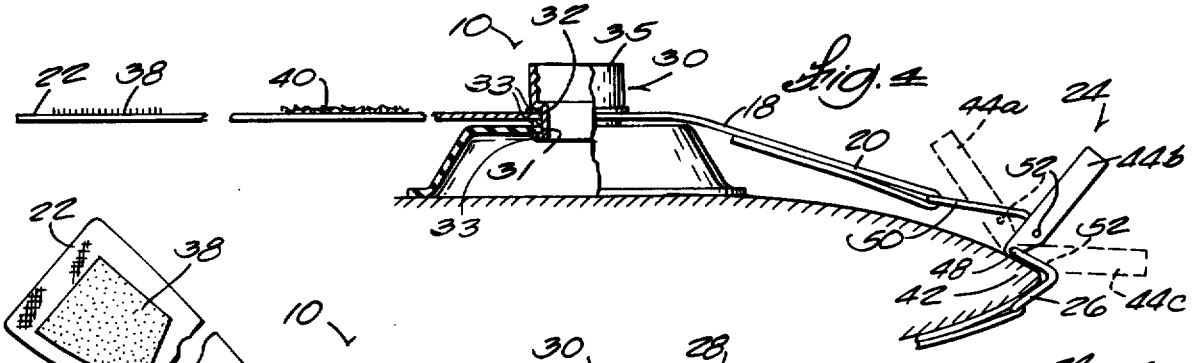
FIG. 4 is a partial side plan view (partially in section) of an alternative embodiment of the flushing device shown in FIG. 1, and illustrates an over-the-center latch with open and closed positions shown in broken lines, and with an above-center position shown in solid lines the second end of the strap being shown twice, i.e. extended and looped, for clarification.
Figure 5:
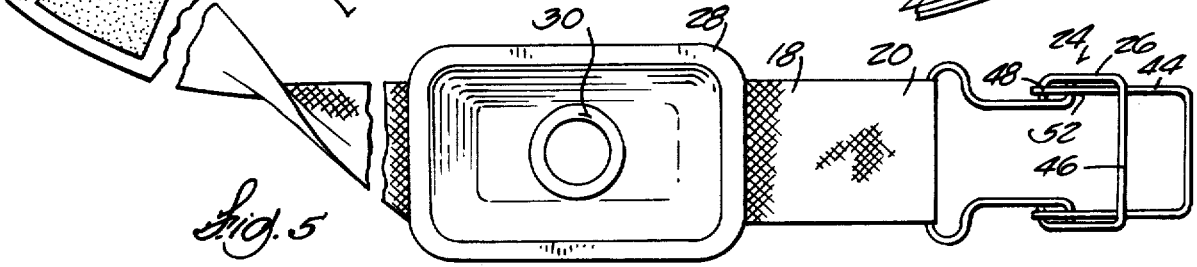
FIG. 5 is a bottom plan view of the flushing device shown in FIG. 4.

An alternative embodiment of the invention is shown in FIGS. 4 and 5 wherein the fastening means comprise fastening members which include synthetic materials which adhere when pressed together. The synthetic materials include a male tape portion employing a plurality of small hooks and a female tape portion employing a plurality of small loops, which portions are sold under the trademark "VELCRO". Specifically, the reciprocal fastening means connected to the strap 18 include a male Velcro tape portion 38 and a female Velcro tape portion 40.

Figure 3:
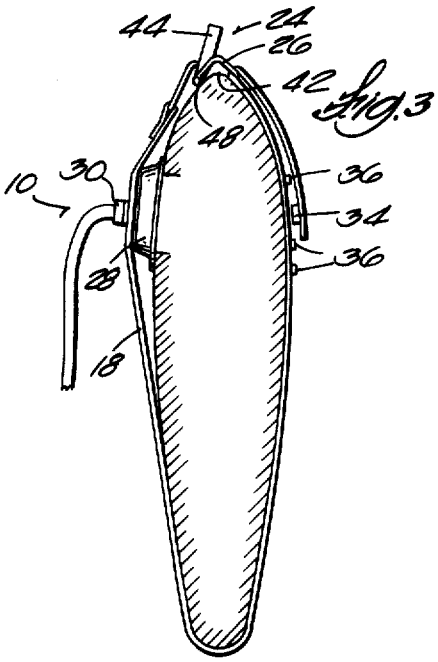
FIG. 3 is a sectional view taken along line 3—3 of FIG. 1.
Figure 2:
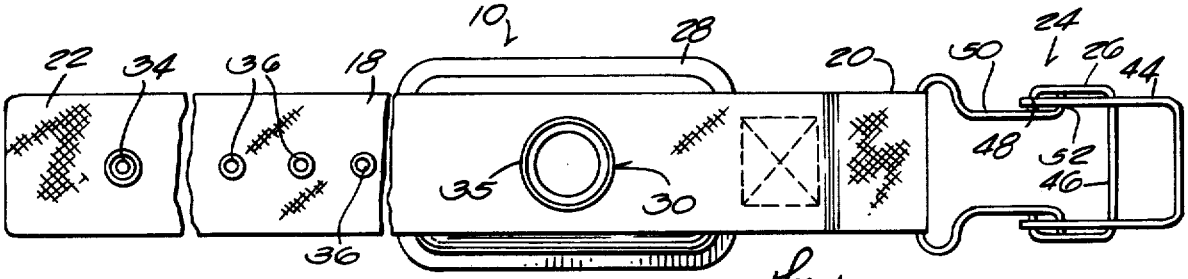
FIG. 2 is a partial top plan view of the flushing device shown in FIG. 1.

In the preferred embodiments shown, the reciprocal fastening means comprise a first fastening member adjacent the second end 22 of the strap, and a plurality of second fastening members spaced from the first fastening member for adjustably securing the strap 18 around different size lower units. As shown in FIGS. 2 and 3, a plurality of male snaps 36 are spaced apart from each other and from the female snap 34 a predetermined distance, so that the strap 18 can be adjustably secured around outboard motors having different size lower units.

As shown in FIGS. 4 and 5, one or more female Velcro tape portions 40 can be spaced from the male Velcro tape portion 38 adjacent the second end 22 of the strap 18. The female Velcro tape portion 40 can be dimensioned to extend along a continuous length of the strap 18. The male Velcro tape portion 38 adheres to the female Velcro tape portion 40 at any point where the two Velcro tape portions are pressed together. The Velcro tape portions thus provide a range of continuous adjustment for securing the strap 18 around different size lower units.

As best shown in FIGS. 3 and 4, the lower unit 14 has a pair of sidewalls which join together to form a apex 42. The kinked portion 26 of the buckle 24 is preferably adapted to fit over and engage the apex 42, thereby registering the cup-shaped member 28 with respect to the water intake port 12. The kinked portion 26 also preferably includes a cross member 46 about which the strap 18 is looped, as will be explained in more detail below.

The flushing device 10 can be installed around the lower unit 14 by placing the kinked portion 26 in engagement with and over the apex 42 of the lower unit. The strap 18 is then guided around the lower unit and the second end 22 of the strap is looped around the cross member 46. Since the kinked portion 26 engages the apex 42, after the strap 18 has been looped around the cross member 46, the second end 22 of the strap 18 can be pulled relatively taught, and the reciprocal fastening means can be aligned and connected together.

While various arrangements are possible, the buckle 24 preferably includes an over-the-center latch 44 pivotally connected to the kinked portion 26. The kinked portion pivotal connection (designated 48) is the point about which the latch 44 is pivoted over center as will be described in more detail below. The buckle also preferably includes means for connecting the first end 20 of the strap 18 to the latch 44 at a point radially outwardly spaced from the kinked portion pivotal connection 48. In the preferred construction shown, the connecting means comprises a strap link 50 connected in a conventional manner to the first end 20 of the strap 18. The strap link 50 includes an end portion 52 which is pivotally connected to the latch 44, which end portion is connected to the latch at a point radially outwardly spaced from the kinked portion pivotal connection 48.

During installation of the strap, the latch 44 is pivoted to its open position designated 44*a* as shown in FIG. 3. In the open position 44*a* the latch 44 can be utilized to steady the strap 18 and hold the kinked portion 26 in engagement with the apex 42 while positioning the strap around the lower unit and while looping the second end 22 of the strap around the kinked portion cross member 46. After the strap has been pulled relatively taught, and the reciprocal fastening means connected together, the latch 44 is pivoted over center further tightening the strap and locking the flushing device around the lower unit.

More specifically, the over-the-center latch 44 is pivoted about the kinked portion pivotal connection 48 from the open position 44*a* to an unstable above-center position designated 44*b* and then to an over-the-center closed or locked position 44*c*. As can be readily appreciated, when the over-the-center latch 44 is pivoted over center toward the buckle kinked portion 26, the end portion 52 of the strap link 50 and the first end 20 of the strap 18 are also displaced toward the buckle kinked portion 26 and thus the strap is tightened.

As noted above, preferably the cup-shaped member 28 is composed of an elastomeric material such as rubber. When the strap 18 is put under further tension during the closing operation of the over-the-center latch 44, the cup-shaped member 28 is compressed thus facilitating sealing engagement of the member 28 with the lower unit 14.

Various features of the invention are set forth in the following claims.

What is claimed is:

1. A flushing device for supplying fluid to a water intake port on a lower unit of a marine propulsion device, the lower unit having side walls which join together to form an apex, said flushing device comprising a flexible strap having a first end and a second end, a buckle connected to said first end, said buckle including a kinked portion adapted to fit over and engage the apex, a member connected to said strap and spaced from said buckle to register said member with respect to the water intake port, said member being adapted for sealing engagement with the lower unit and for covering the water intake port, said member including a conduit adapted for communication with the water intake port and with a source of fluid, and fastening means on said strap for securing said strap around the lower unit.

2. A flushing device in accordance with claim 1 wherein said fastening means comprises spaced reciprocal fastening means connected to said strap adjacent said second end.

3. A flushing device in accordance with claim 2 wherein said buckle includes an over-the-center latch pivotally connected to said kinked portion, said kinked portion having a cross member, said buckle also including means for connecting said first end of said flexible strap to said latch at a point radially outwardly spaced from said kinked portion pivotal connection with said latch, wherein said strap is looped around said cross member so that said reciprocal fastening means can be aligned and connected together, and wherein said strap is tightened and locked around the lower unit when said latch is pivoted over center about said kinked portion pivotal connection.

4. A flushing device in accordance with claim 3 wherein said connecting means comprises a strap link connected to said first end of said strap, said strap link having an end portion spaced from said first end of said strap and pivotally connected to said latch, and wherein, when said latch is pivoted over center, said strap link end portion and said first end of said strap are pivoted and displaced toward said buckle kinked portion so that said strap is tightened and locked around the lower unit.

5. A flushing device in accordance with claim 1 wherein said strap includes an aperture spaced from said buckle, and wherein said member comprises a cup-shaped member, and said conduit extends through said aperture, said conduit having a rotatably mounted adapter for connection to a garden hose.

6. A flushing device in accordance with claim 2 wherein said member is dimensioned to sealingly engage different size lower units, and wherein said reciprocal fastening means comprise a first fastening member adjacent said second end and a plurality of reciprocal second fastening members spaced from said first fastening member for adjustably securing said strap around the different size lower units.

7. A flushing device in accordance with claim 2 wherein said reciprocal fastening means include a male snap and a female snap.

8. A flushing device in accordance with claim 2 wherein said reciprocal fastening menas include synthetic materials which adhere when pressed together.

9. A flushing device in accordance with claim 1 wherein said strap is composed of nylon.

10. A flushing device for supplying fluid to a water intake port on a lower unit of a marine propulsion device, the lower unit having sidewalls which join together to form an apex, said device comprising a flexible strap having a first end, an aperture spaced from said first end, and a second end, a buckle including a kinked portion adapted for engagement with the apex of the lower unit, said kinked portion having a cross member, said buckle also including an over-the-center latch pivotally connected to said kinked portion, said buckle also including means for connecting said first end of said flexible strap to said latch at a point radially outwardly spaced from said kinked portion pivotal connection with said latch, a cup-shaped member connected to said strap and spaced from said buckle, said cup-shaped member being adapted for sealing engagement with the lower unit and for covering the water intake port, said cup-shaped member including a conduit extending through said aperture, said conduit being adapted for communication with the water intake port and having a rotatably mounted adapter for connection to a garden hose, and spaced reciprocal fastening means connected to said strap adjacent said second end so that, when said strap is looped around said cross member, said reciprocal fastening means can be aligned and connected together, and so that when said latch is pivoted over center about said kinked portion pivotal connection, said strap is tightened and locked around the lower unit.

11. A flushing device in accordance with claim 10 wherein said connecting means comprises a strap link connected to said first end of said strap, said strap link having an end portion spaced from said first end of said strap and pivotally connected to said latch, and wherein, when said latch is pivoted over center, said strap link end portion and said first end of said strap are pivoted and displaced toward said buckle kinked portion so that said strap is tightened and locked around the lower unit.

12. A flushing device in accordance with claim 10 wherein said cup-shaped member is dimensioned to sealingly engage different size lower units, and wherein said reciprocal fastening means comprise a first fastening member adjacent said second end, and a plurality of reciprocal second fastening members spaced from said first fastening member for adjustably securing said strap around the different size lower units.

13. A flushing device in accordance with claim 10 wherein said reciprocal fastening means include a male snap and a female snap.

14. A flushing device in accordance with claim 10 wherein said reciprocal fastening means include synthetic materials which adhere when pressed together.

15. A flushing device for supplying fluid to a water intake port on a lower unit of a marine propulsion device, said flushing device comprising a flexible strap, fastening means connected to said strap for securing said strap around the lower unit, a member connected to said strap and adapted for sealing engagement with the lower unit and for covering the water intake port, said member including a conduit adapted for communication with the water intake port and with a source of fluid, locating means connected to said strap for engagement with the lower unit in a position to locate said member with respect to the lower unit so that said member covers the water intake port, and means for releasably taking up slack in said strap when said strap is secured around the lower unit by said fastening means to thereby prevent displacement of said locating means from said position locating said member with respect to the lower unit.

16. A flushing device for supplying fluid to a water intake port on a lower unit of a marine propulsion device, said flushing device comprising a flexible strap, fastening means connected to said strap for securing said strap around the lower unit, a member connected to said strap and adapted for sealing engagement with lower unit and for covering the water intake port, said member including a conduit adapted for communication with the water intake port and with a source of fluid, and a buckle connected to said strap and including a portion adapted for engagement with the lower unit to locate said member with respect to the lower unit so that said member covers the water intake port, said buckle including means for releasing and taking up slack in said strap when said strap is secured around the lower unit by said fastening means.

* * * * *